US011738234B2

(12) United States Patent
Barban

(10) Patent No.: US 11,738,234 B2
(45) Date of Patent: Aug. 29, 2023

(54) APPARATUS FOR PHYSICAL ACTIVITY COMPRISING A REVOLVING BELT

(71) Applicant: Gianfranco Barban, Gallarate (IT)

(72) Inventor: Gianfranco Barban, Gallarate (IT)

( * ) Notice: Subject to any disclaimer, the term of this patent is extended or adjusted under 35 U.S.C. 154(b) by 222 days.

(21) Appl. No.: 17/256,407

(22) PCT Filed: Jul. 1, 2019

(86) PCT No.: PCT/EP2019/067609
§ 371 (c)(1),
(2) Date: Dec. 28, 2020

(87) PCT Pub. No.: WO2020/007799
PCT Pub. Date: Jan. 9, 2020

(65) Prior Publication Data

US 2021/0268330 A1 Sep. 2, 2021

(30) Foreign Application Priority Data

Jul. 4, 2018 (EP) ..... 18181703

(51) Int. Cl.
*A63B 22/02* (2006.01)
*A63B 24/00* (2006.01)
(Continued)

(52) U.S. Cl.
CPC ..... *A63B 22/0285* (2013.01); *A63B 24/0087* (2013.01); *A63B 71/0054* (2013.01);
(Continued)

(58) Field of Classification Search
CPC ..... A63B 22/02–0292; A63B 24/0087; A63B 2024/0093; A63B 71/0054;
(Continued)

(56) References Cited

U.S. PATENT DOCUMENTS 6,217,487 B1 * 4/2001 Reinert ..... A63B 22/0005 482/54
9,433,819 B1 * 9/2016 Carducci ..... A63B 22/0012
(Continued)

FOREIGN PATENT DOCUMENTS

CN 102058957 A 5/2011
CN 107158648 A 9/2017
(Continued)

OTHER PUBLICATIONS

Translation of Ohta (EP 1186322 A2) (Year: 2002).*
(Continued)

*Primary Examiner* — Jennifer Robertson
*Assistant Examiner* — Sara K. Conway
(74) *Attorney, Agent, or Firm* — Akerman LLP

(57) ABSTRACT

The present invention relates to an apparatus (100, 1001, 1002) for physical activity, comprising: a frame (101); a plurality of rollers (203, 204) rotatably connected to the frame (101); a belt (200) mounted on the plurality of rollers (203, 204) and revolving to define moving belt surfaces (201, 202) comprising: an activity belt surface (201) being configured for physical activity of at least one user (301, 701) and delimited by a side of the frame (101), and a return belt surface (202) being configured for revolving the belt (200) in a never-ending loop; the return belt surface (202) is elevated with respect to the activity belt surface (201).

14 Claims, 6 Drawing Sheets

(51) Int. Cl.

| | |
|---|---|
| ***A63B 71/00*** | (2006.01) |
| ***A63B 71/06*** | (2006.01) |
| ***A61H 3/00*** | (2006.01) |
| ***A63B 69/00*** | (2006.01) |

(52) U.S. Cl.
CPC ..... *A63B 71/0622* (2013.01); *A61H 3/008* (2013.01); *A63B 22/0214* (2015.10); *A63B 69/0064* (2013.01); *A63B 2024/0093* (2013.01); *A63B 2071/0081* (2013.01)

(58) Field of Classification Search
CPC ..... A63B 71/0622; A63B 2071/0081; A63B 69/0064; A61H 3/008; A01K 1/0041; A01K 1/031; A01K 15/02; A01K 15/027; A63G 1/08; A63G 1/10; A63G 1/12; A63G 1/14; A63J 9/00
See application file for complete search history.

(56) References Cited

U.S. PATENT DOCUMENTS

2009/0176629 A1* 7/2009 Yi ..... A63B 22/025 482/54
2016/0367859 A1 12/2016 Ai et al.
2017/0333748 A1* 11/2017 Becker ..... A63B 22/0228
2018/0110236 A1* 4/2018 Donoughe ..... A23L 2/00
2018/0140496 A1* 5/2018 San ..... A61B 5/112
2018/0369634 A1* 12/2018 Kueker ..... A63B 22/0023

FOREIGN PATENT DOCUMENTS

| | | | | |
|---|---|---|---|---|
| DE | 10 2011 119645 | A1 | 5/2013 | |
| DE | 20 2017 101839 | U1 | 5/2017 | |
| EP | 1186322 | A2 * | 3/2002 | ..... A63B 22/0235 |
| GB | 583 414 | A | 12/1946 | |
| GB | 989 454 | A | 4/1965 | |
| KR | 20080080076 | A | 9/2008 | |
| WO | 2005/030342 | A1 | 4/2005 | |

OTHER PUBLICATIONS

Written Opinion of the International Searching Authority issued in connection with PCT/EP2019/067609.
International Search Report issued in connection with PCT/EP2019/067609.
Office Action and Search Report dated Oct. 15, 2021 issued in connection with corresponding Chinese Patent Application No. 2021101202221150.

* cited by examiner

APPARATUS FOR PHYSICAL ACTIVITY COMPRISING A REVOLVING BELT

CROSS-REFERENCE TO RELATED APPLICATIONS

This application is a national phase of PCT/EP2019/067609, filed Jul. 1, 2019, and claims priority to EP 18181703.2, filed Jul. 4, 2018, the entire contents of both of which are hereby incorporated by reference.

FIELD OF THE INVENTION

The present invention relates to an apparatus for physical activity, comprising a revolving belt accessible by a user.

In general, the present invention relates to exercising or physical training apparatuses, specially adapted for conditioning the cardio-vascular system, for training agility or co-ordination of movements, and for recreative purposes, in particular for indoor use.

Background Art

A treadmill is an apparatus for physical activity, generally for walking or running, while staying in a same location.

Treadmills were originally introduced before the development of powered machines, to harness the power of animals or humans to do work; often a mill was operated by a person or animal treading steps of a treadwheel, to grind grain. In more recent times, treadmills are no longer used to harness power, but as exercise machines for running or walking.

The treadmill machine provides a moving surface of a wide conveyor belt, typically driven by an electric motor or a flywheel.

In a treadmill, while the user stands on the belt, the latter moves to the rear thus requiring the user to walk or run at a speed matching that of the belt. The rate at which the belt moves is the rate of walking or running of the user, and can be controlled accordingly.

Among the users of treadmills today, there are medical facilities (hospitals, rehabilitation centers, medical and physiotherapy clinics, institutes of higher education), sports clubs, orthopedic shoe shops, running shops, training centers, gyms, universities, NASA, test facilities and training rooms of police, firemen and army, and even home users.

Known treadmills have the disadvantage of having a belt surface which is hard to access by the user, since there is a height gap between the running surface of the belt and the floor level, upon which the treadmill rests.

Therefore, certain users such as people undergoing physiotherapy, people with physical disabilities or elders, may find it hard to access known types of treadmills.

Moreover, known treadmills can be dangerous as the user may fall off the step of the running surface.

It is an objective of the present invention to solve drawbacks of the prior art.

In particular, it is an object of the present invention to provide an apparatus for physical activity which is improved with respect to treadmills of the prior art.

It is a further object of the present invention to provide an apparatus for physical activity, wherein accessibility of the belt surface is improved.

It is a further object of the present invention to provide an apparatus for physical activity which improves safety for a user thereof.

It is a further object of the present invention to provide an apparatus for physical activity which offers added operational features.

SUMMARY OF THE INVENTION

These and other objects of the present invention are achieved by an apparatus for physical activity according to features set out in the appended claims, which are an integral part of the present description.

An idea underlying the present invention is to provide an apparatus for physical activity, comprising: a frame; a plurality of rollers rotatably connected to the frame; a belt mounted on the plurality of rollers and revolving to define moving belt surfaces; the moving belt surfaces comprise an activity belt surface being configured for physical activity of at least one user and delimited by a side of the frame, and a return belt surface being configured for revolving said belt in a never-ending loop; the return belt surface is elevated with respect to said activity belt surface.

Advantageously, better access to the activity belt surface is achieved by having an elevated return surface. Also, advantageously, the risk of falling from the activity belt surface is reduced, thereby improving safety. Moreover, advantageously, the configuration of apparatus for physical activity according to the invention allows further features to be easily integrated, and provides for innovative modes of use.

According to a preferred embodiment, the frame defines an elevated loop structure, so that the return belt surface runs above the activity belt surface. Advantageously, the configuration according to the invention is more effective in providing the user with an of apparatus for physical activity, which can be carried out while standing in a fixed location, for example indoor.

According to a preferred embodiment, the activity belt surface remains substantially on a floor level. Advantageously, access to the activity belt surface and safety of use are further improved.

Other features and advantages of the invention will be apparent from the following description of preferred embodiments, and from the dependent claims which define further advantageous features of the invention.

BRIEF DESCRIPTION OF THE DRAWINGS

The invention will be now described with reference to the annexed drawings, provided as non-limiting examples of preferred embodiments, wherein.

In the various drawings, the same reference numerals will designate the same or equivalent elements.

DETAILED DESCRIPTION OF THE INVENTION

Figure 1:
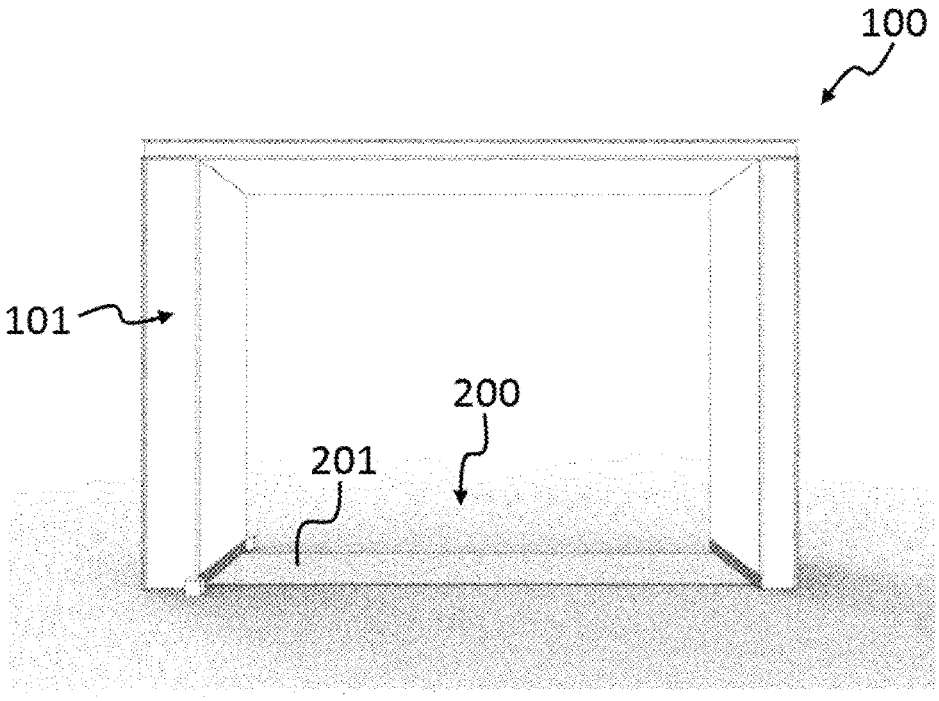
FIG. 1 illustrates an apparatus for physical activity according to a first exemplificative embodiment of the invention.

FIG. 1 illustrates an apparatus 100 for physical activity according to a first exemplificative embodiment of the invention.

The apparatus 100 comprises a frame 101 which defines an enclosed space for a user, as it will be further described.

In the context of the present invention, the term "user" defines a human user, being an adult or younger person, who performs any kind of physical activity which can be performed by a human user on a flat surface, such as walking, running or the like.

The apparatus 100 further comprises a revolving belt 200 which defines moving surfaces, including an activity belt surface 201 which is configured for moving, so that the user can do physical activity while remaining at a location substantially fixed with respect to the frame 101.

The activity belt surface 201 is delimited by a side of the frame 101, in particular by a bottom side thereof.

As it can be seen, the activity belt surface 201 is substantially on a floor level, so that it can be easily accessed by a user.

It is to be understood that the surface indicated in the present description as "floor", can be any surface upon which the apparatus 100 rests; in that sense, the floor can be any ground of an outside environment, or any level of a building.

It is also to be understood that the size of the apparatus 100 can be varied according to the desired application or space constraints.

Figure 2:
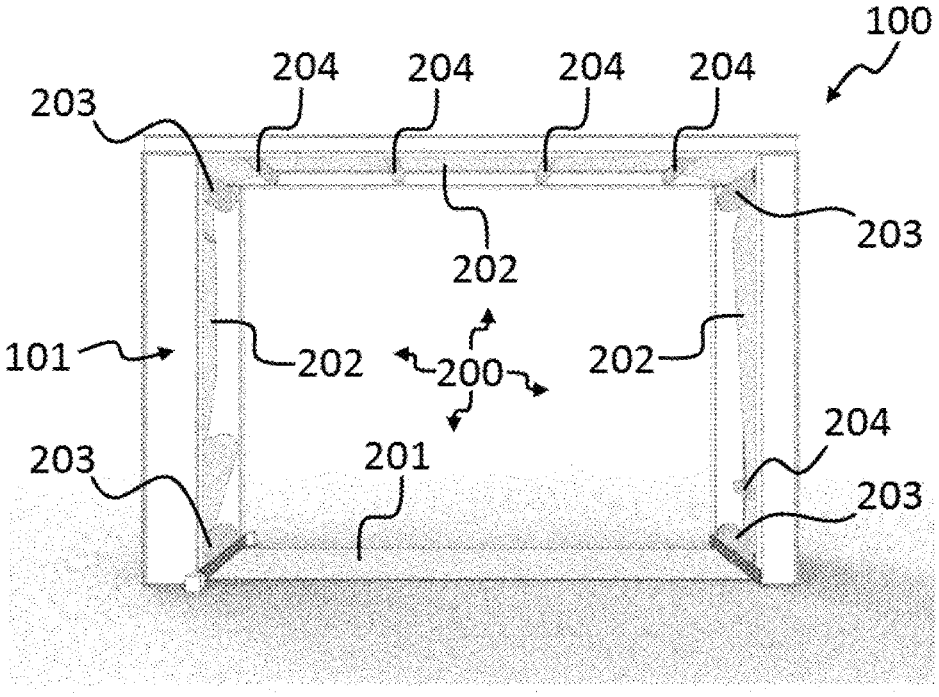
FIG. 2 illustrates the apparatus for physical activity of FIG. 1, partly disassembled.

FIG. 2 illustrates the apparatus 100 for physical activity, partly disassembled so that some aesthetic and/or functional covers are removed, in order to make below elements clearly visible.

In particular, it is made visible the whole loop of the belt 200 which defines a moving belt surface, preferably elevated around the inner part of the apparatus 100 and configured for access of the user.

The belt 200 comprises a return belt surface 202, defined by two vertical tracts and an upper horizontal tract. In other words, the return belt surface 202 is delimited by one or more top side(s) of the frame 101.

The return belt surface 202 is configured for cooperating with the activity belt surface 201. In particular, the return belt surface 202 is configured for revolving the belt 200 in a never-ending loop.

The apparatus 100 comprises a plurality of rollers 203, 204 which are rotatably connected to the frame 101, so that the belt 200 mounted thereon can revolve and develop the moving belt surfaces 201 and 202 already described.

The return belt surface 202 is elevated with respect to the activity belt surface 201. As a consequence, the activity belt surface 201 has a reduced height gap with the floor level, or is substantially on a floor level, so that it can be easily accessed by a user. Moreover, the activity belt surface 201 provides for an activity area of the revolving belt 200 which is safer to use, reducing risks of falling or tripping.

The frame 101 is configured to define an elevated loop structure, so that the return belt surface 202 runs above the activity belt surface 201.

Therefore, the apparatus 100 allows a user standing on the activity belt surface 201 to walk or run thereon, while the belt 200 revolves in a never-ending manner along the path of the return belt surface 202.

In other words, the apparatus 100 is configured so that a user standing inside can walk or run on the belt 200, while remaining at a location substantially fixed with respect to the frame 100. For this reason, the apparatus of the present invention is particularly suited for indoor activity.

In a variant, not shown, the return belt surface 202 would still be elevated with respect to the activity belt surface 201 for providing the belt loop, but would run on the side of the user, by means of an appropriate bend in the trajectory of the belt; in this case, the return belt surface 202 would not run above the activity belt surface 201, but would run aside thereof. In this variant as well, the activity belt surface can remain substantially at floor level, with the described advantages.

In another variant, not shown, the belt would develop in a loop like a Möbius strip. In this another variant, the belt made as a Möbius strip could last longer because its entire surface area would get the same amount of wear.

Figure 3:
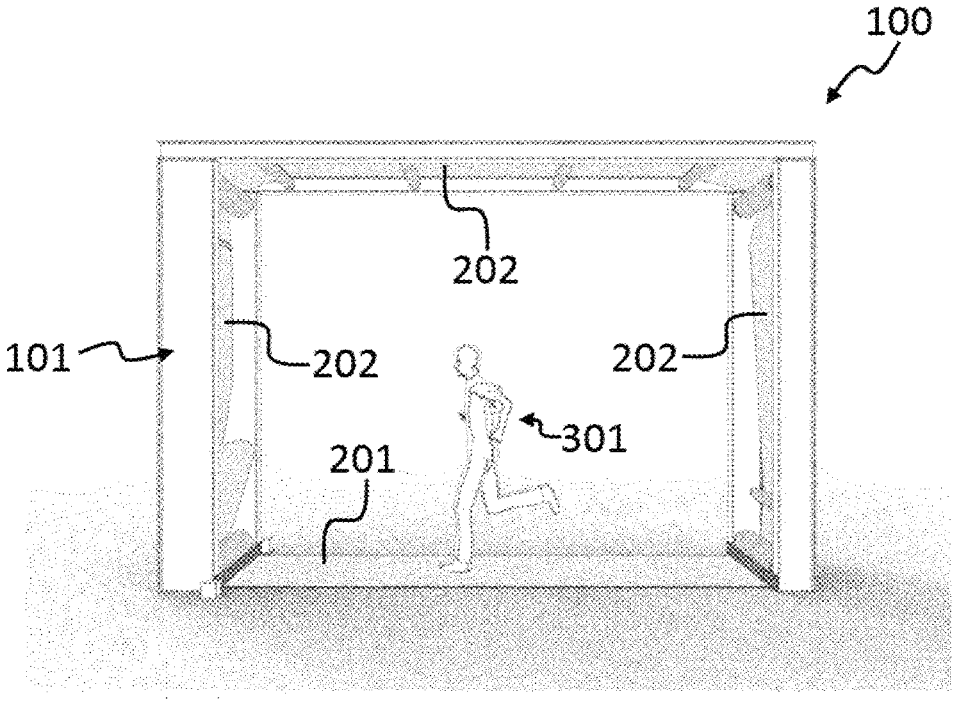
FIG. 3 illustrates the apparatus for physical activity of FIG. 2, upon which a user runs.

FIG. 3 illustrates the apparatus 100 for physical activity, upon which a user 301 runs.

The apparatus 100 comprises the elevated loop structure, in particular defined by the frame 101, which is sized so as to allow the user 301 to stand on the activity belt surface 201, while remaining below the return belt surface 202.

The activity belt surface 201 represents, for the user 301, a tract of moving belt wherein the user 301 can do physical activity, such as walking or running, or even bicycling with the bicycle's wheels moving against the belt surface.

Moreover, the apparatus 100 could be sized such that more than one user occupies the available activity belt surface. For example, two or more users moving in a same direction could do physical activity on the belt, for example running or walking together in a same direction.

As visible, the activity belt surface 201 is substantially on a floor level, so that it can be easily accessed by the user 301. Moreover, the user 301 can be assisted by a medical operator which stands aside the activity belt surface 201, substantially on the same level of the user 301; this is particularly advantageous when the user 301 is undergoing assisted physiotherapy.

In fact, the activity belt surface 201 can appear like a regular carpet or floor element, but still exhibits the features of a moving belt as above described.

Figure 4:
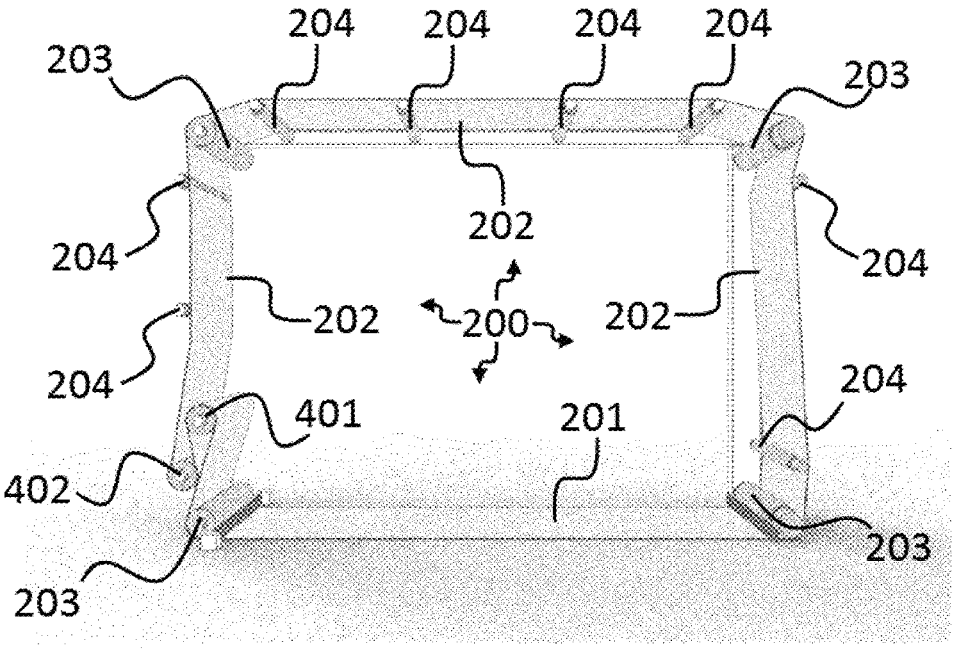
FIG. 4 illustrates the apparatus for physical activity of FIG. 2, further disassembled to view internal elements.

FIG. 4 further illustrates some internal elements of the apparatus 100.

The apparatus 100 comprises a plurality of rollers 203 and 204. In a preferred embodiment, the rollers 203 are associated to the frame 101 to provide the overall loop structure for the belt 200, while the rollers 204 provide further support to the elevated loop structure thereby avoiding slacking of the belt.

The apparatus 100 further comprises at least one motor associated to a driving roller 401; the motor is adapted for driving the belt to a suitable speed for physical activity of the user. In particular, there could be more than one motor, directly coupled and/or coupled by means of a transmission, to one or more driving roller(s). The motor is preferably electric, and powered by an inverter.

In a preferred embodiment, the apparatus 100 further comprises a tensioning system for varying the tension of the belt 200 and optimizing functioning thereof.

In the depicted embodiment, the tensioning system comprises a displaceable roller 402 which is adapted for being moved in vertical direction. By moving the roller 402, the length of the never-ending loop of the belt 200 can be varied, thereby varying and regulating the tension of the belt 200. The tensioning system can also include a displaceable element associated to one of the rollers 204. Other tensioning systems can be used.

In a preferred embodiment, the apparatus 100 further comprises steerable members which are provided for varying the inclination of at least one roller 203, in order to provide centering of the belt 200 for stable operation. The centering system can also include a steerable element associated to one of the rollers 204. Other centering systems can be used.

The belt 200 is supported by the frame, which is omitted in FIG. 4 for improving visibility of other elements. In that, it can be understood that the term "frame" is to be construed as any structure capable of supporting the plurality of rollers in order to define the elevated loop structure. Therefore, the "frame" can be constituted of one or more frame elements, connected or separated, as far as they are suitably constrained so as to properly support the rollers 203. In an example, the frame could be made in more than one piece, also cooperating with an external structure such as one or more wall(s).

The belt 200 can slide directly on the floor, if the roughness of the floor so allows. Further systems for reducing friction can be used, as it will be further described.

In a preferred embodiment, the belt 200 comprises a suitable flexible material band, which can be a polymeric material or a net-like structure.

In another embodiment, the belt comprises a plurality of interjoined track plates, such as a "caterpillar belt". In this case, each one of the track plates can comprise respective sliding elements, such as small rollers or sleds or the like, to reduce friction with the floor surface.

In general, the apparatus 100 can include a cleaning system for cleaning the belt from dirt which may accumulate thereon.

Figure 5:
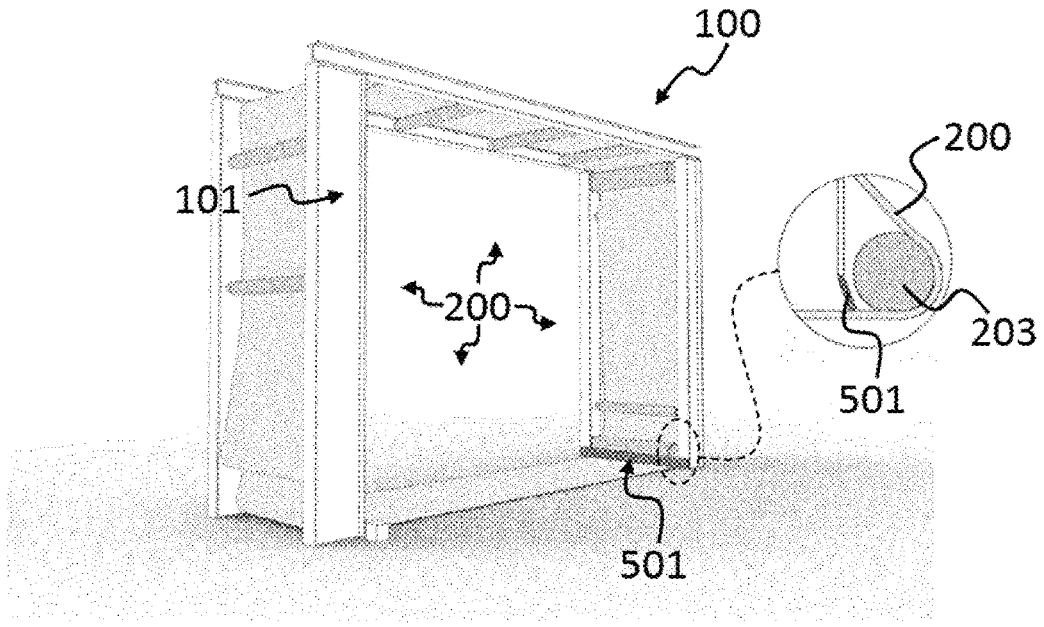
FIG. 5 illustrates a further view of the apparatus for physical activity of FIG. 2, and a detail thereof.

FIG. 5 illustrates a further view of the apparatus 100 for physical activity, which comprises a mechanical safety 501. The mechanical safety 501 comprises an element such as a strip or wire which, when impacted, causes the belt 200 to stop so that the user cannot get tangled in the revolving belt. This safety system is preferably complemented by further safety systems based on a detection system.

Figure 6:
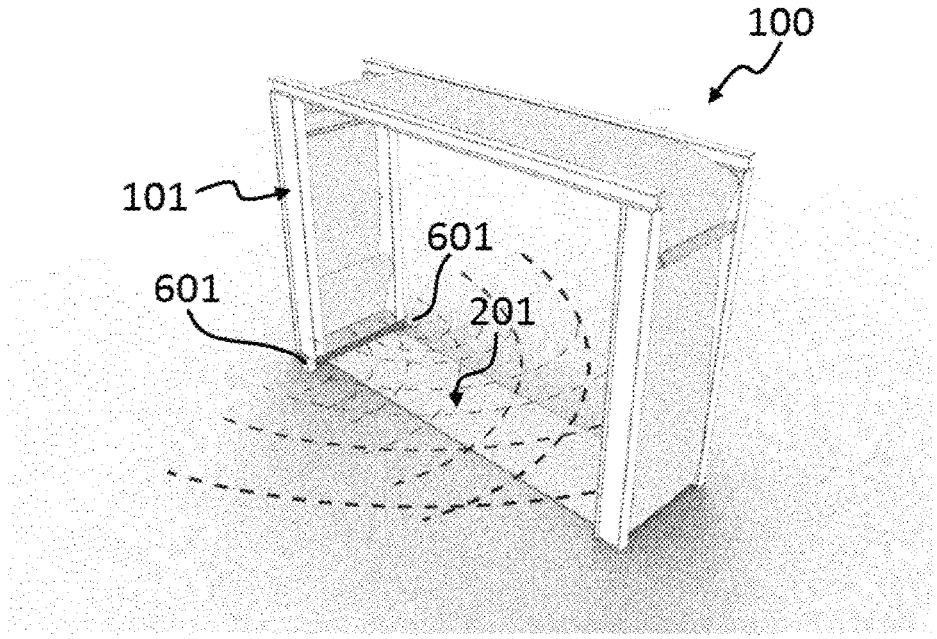
FIG. 6 illustrates the operation of an apparatus for physical activity according to the invention.

FIG. 6 illustrates the operation of the apparatus for physical activity 100. The apparatus 100 comprises a detection system 601 for detecting the position of the user on the activity belt surface 201. Preferably, the detection system 601 is based on radar, infrared or laser technologies. In alternative or in addition, the detection system could comprise physical sensors, arranged under the belt surface, preferably in a sliding table as it will be described.

The detection system 601 detects the position of the user, both for safety and operation control. In a preferred embodiment, the detection system 601 can cooperate with an active element associated to the user, such as a wearable device which is adapted for positional detection.

Figure 7:
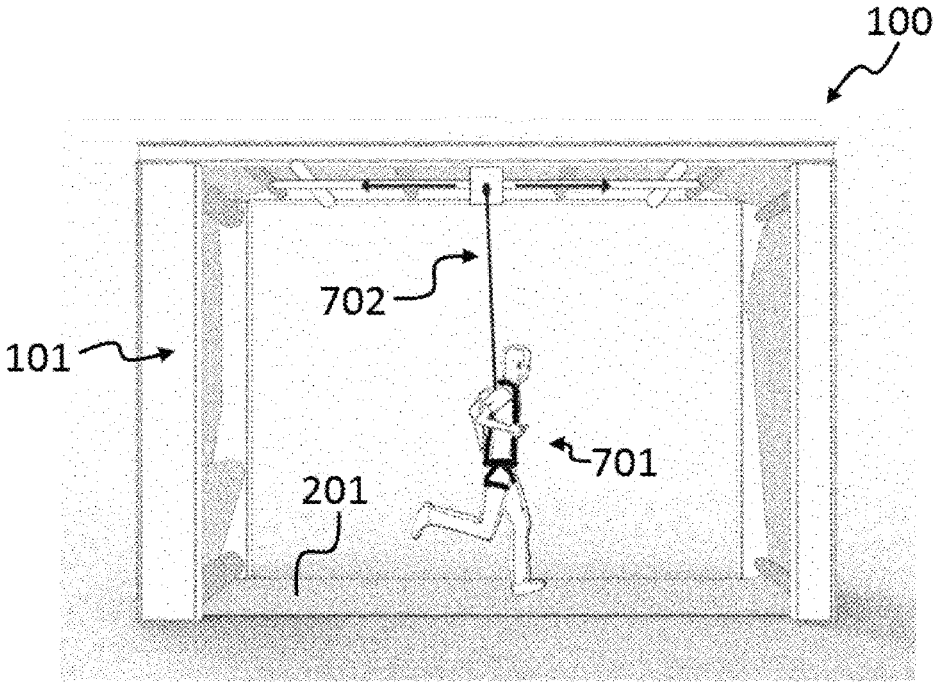
FIG. 7 further illustrates the operation of an apparatus for physical activity according to the invention.

FIG. 7 further illustrates the operation of the apparatus 100 for physical activity. The user 701 can move on the active belt surface 201 while being supported by a harness system 702 which is preferably capable of translating in horizontal direction, being connected to the frame 101. The harness system 702 could also be connected at a fixed location of the frame 101.

The frame 101 and the harness system 702 are configured for supporting the weight of the user 701, and provide an aid for people with limited physical abilities.

Figure 8:
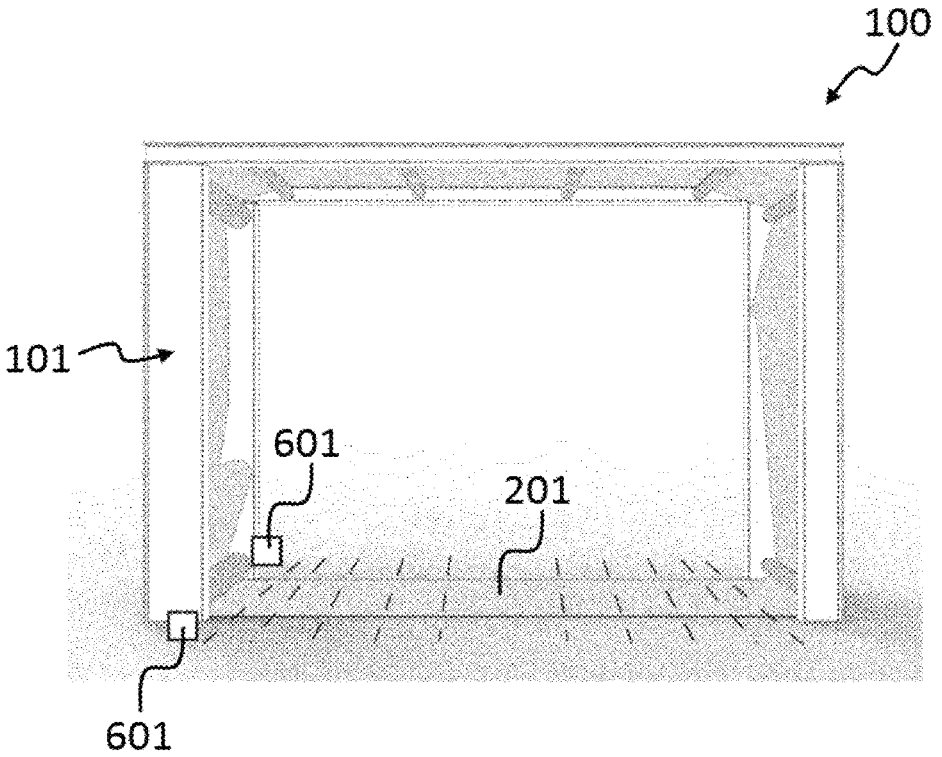
FIG. 8 further illustrates the operation of an apparatus for physical activity according to the invention.

FIG. 8 further illustrates the operation of the apparatus 100 for physical activity.

As described, the detection system 601 is configured for detecting the position of at least one user on the belt. Preferably, the revolving speed of the belt can be controlled depending on the detected position of the user.

Moreover, it is noted that the belt 200 can revolve in both directions, according to the moving direction of the user on the activity surface 201, thereby improving flexibility of use. In the present description, any reference to "front" or "back" shall be considered in relation to the direction faced by the user, and the current revolving direction of the belt 200.

If the user is at an appropriate position in the middle of the activity belt surface 201, the revolving speed of the belt is maintained. If the user is at a position closer to the front wall of the apparatus 100, the revolving speed of the belt is increased so that the user can move faster. If the user is at a position closer to the back wall of the apparatus 100, the revolving speed of the belt is decreased so as to match the speed of the user. If the user is at a position dangerously close to the back wall of the apparatus, the revolving speed of the belt is limited or the belt is stopped, for safety purposes.

In a general mode of operation, the user can enter the activity belt surface when the belt is at a standstill. The user can select a working program which is then executed. The user starts running or walking, and the belt gradually accelerates with controlled revolution speed. The user remains in the middle of the activity belt surface, in normal conditions. When the user wants to stop, the user can spread the arms to signal its intention to the apparatus's control, or can stop running and be dragged to a stop zone in automatic manner, or simply walk out of the activity belt surface.

Figure 9:
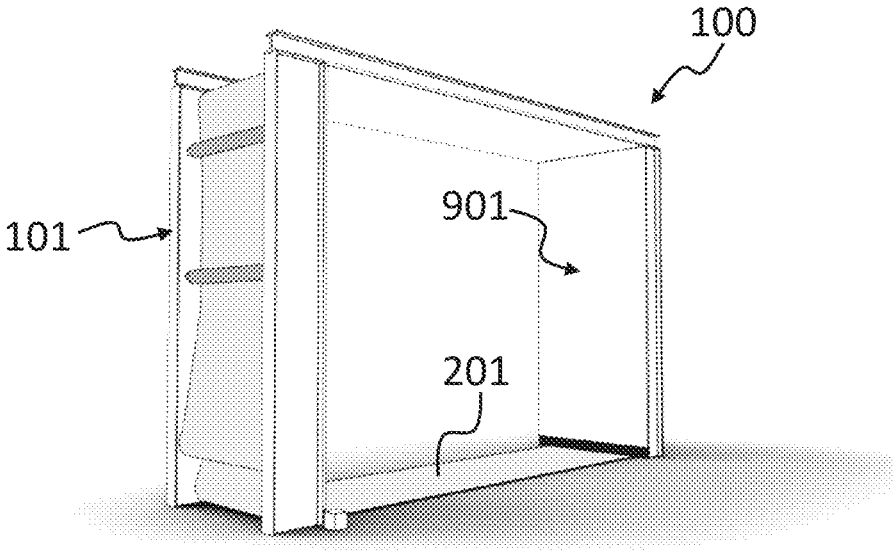
FIG. 9 illustrates a further view of the apparatus for physical activity of FIG. 1, comprising a display.

FIG. 9 illustrates a further view of the apparatus 100 for physical activity which comprises a display 901. Preferably, the display 100 is a flat screen TV. In a variant, a projecting apparatus pointing toward one or more flat surface(s) of the apparatus 100 can be used.

In general, the apparatus 100 comprises a multimedia system which is adapted for providing the at least one user with an enhanced sensory experience. In particular, the multimedia system can provide images and/or sounds which give the impression of moving in an outside environment.

The multimedia system can further enhance the user's experience, for example by providing appropriate simulation for recreational purposes, for example for dancing, and even for dancing in pair with another user. In particular the apparatus 100 is configured, by using the detection system for detecting the position of the user, for controlling the belt in both directions, also in a stepwise manner, in order to maintain the user(s) at a predefined location on the activity surface, while dancing.

The multimedia system can further provide an aid for the simulation of certain games; for example, the multimedia system can emulate walking on a golf course, wherein the apparatus is preferably associated to a golf shooting simulator so that the user can even shoot virtual golf balls.

The multimedia system can also offer statistics and indications for training purposes.

The multimedia system can also play multimedia content which is unrelated to the movement of the belt, for example playing music or a movie.

In general, the multimedia system includes at least the display 901, which remains visible from the activity belt surface.

The apparatus 100 further comprises suitable control interfaces, such as a touchscreen and/or vocal commands. The apparatus 100 can be integrated with a system for detecting vital statistics of the user, for improving training or medical applications.

In an embodiment, the apparatus 100 can include further gesture controls, which can detect position and gestures of a user in order to change the revolution speed or direction of the belt, also in a step-wise manner.

As mentioned, the belt 200 can slide on an appropriate system for reducing friction thereof. To this extent, the apparatus 100 further comprises a sliding table which is configured for supporting a bottom side of the activity belt surface 201.

Figure 10:
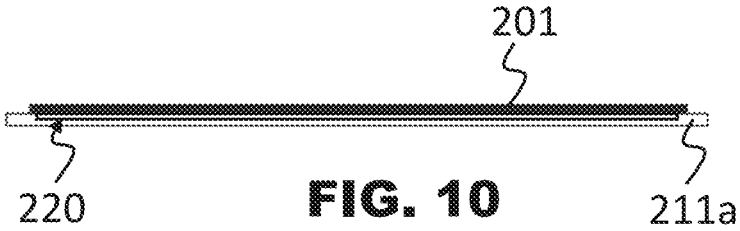
FIG. 10 illustrates a first embodiment of a sliding table for an apparatus for physical activity according to the invention.

FIG. 10 illustrates a first embodiment of a sliding table 211*a*, which reduces friction of the belt at its activity belt surface 201. Friction is reduced by employing appropriate materials, lubricants, or by means of an air cushion.

In general, the sliding table 211*a* can be made of Teflon or of suitable plastic materials or of suitable metals and alloys, such as Inox steel.

Preferably, a damping layer 220 can be interposed between the sliding table 211*a* and the activity belt surface 201, so that impact shocks of the user's feet can be reduced. Alternatively, the damping effect can be provided by the belt itself, if the latter is made of suitable material and having appropriate thickness.

Figure 11:
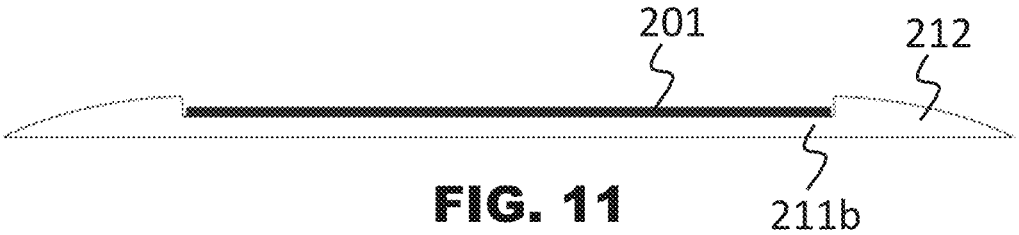
FIG. 11 illustrates a second embodiment of a sliding table for an apparatus for physical activity according to the invention.

FIG. 11 illustrates a second embodiment of a sliding table 211*b*, which in addition to the features illustrated for the sliding table 211*a*, also comprises lateral ramp sections 212 which is configured for improving access for the user, to the activity belt surface 201. Preferably, the sliding table 211*b* also provides a centering effect on the activity belt surface 201, during revolving thereof.

Figure 12:
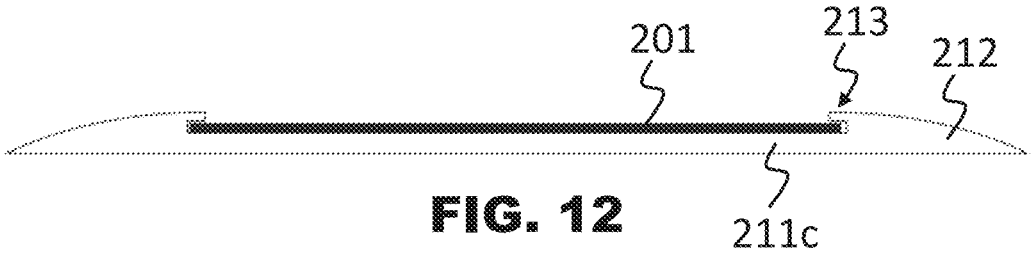
FIG. 12 illustrates a third embodiment of a sliding table for an apparatus for physical activity according to the invention.

FIG. 12 illustrates a third embodiment of a sliding table 211*c*, which in addition to the features illustrated for the sliding table 211*b*, also comprises a protruding cover element 213 connected to each lateral ramp section 212, which partly overlap with the activity belt surface thus reducing risk of body parts, objects or dirt penetrating below the revolving belt.

Figure 13:
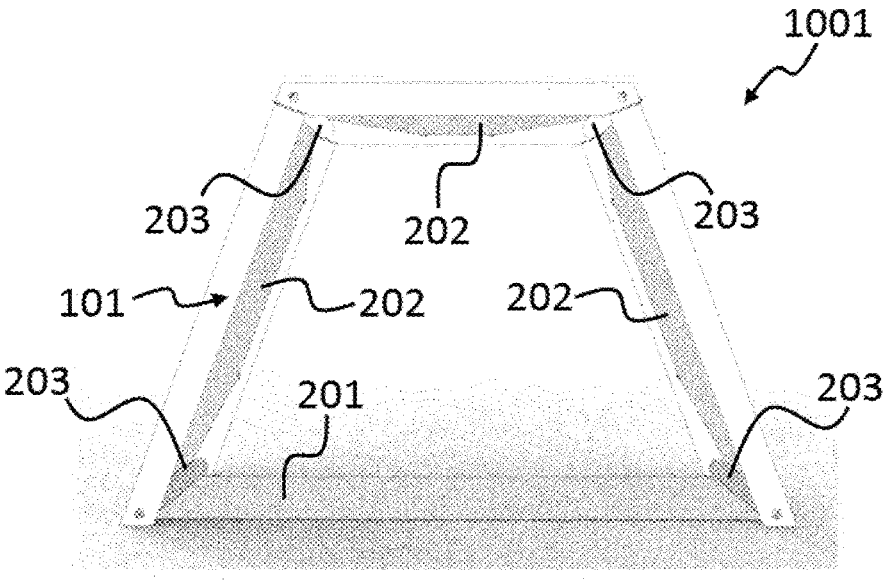
FIG. 13 illustrates a second embodiment of an apparatus for physical activity according to the invention.

FIG. 13 illustrates a second embodiment of an apparatus 1001 for physical activity according to the invention.

The apparatus 1001 comprises a frame 101 which is substantially trapezoidal, mounting a plurality of rollers 203 upon which the belt is mounted in a never-ending loop, as already described.

The return belt surface 202, once again, is elevated with respect to the activity belt surface 201, thereby realizing an activity belt surface 201 with improved accessibility.

The tensioning system of apparatus 1001 provides for a divarication of the lateral frame elements of the frame 101, to increase the length of the trapezoid base thereby increasing the belt's tension.

The apparatus 1001 is compact and adapted for a home use.

Figure 14:
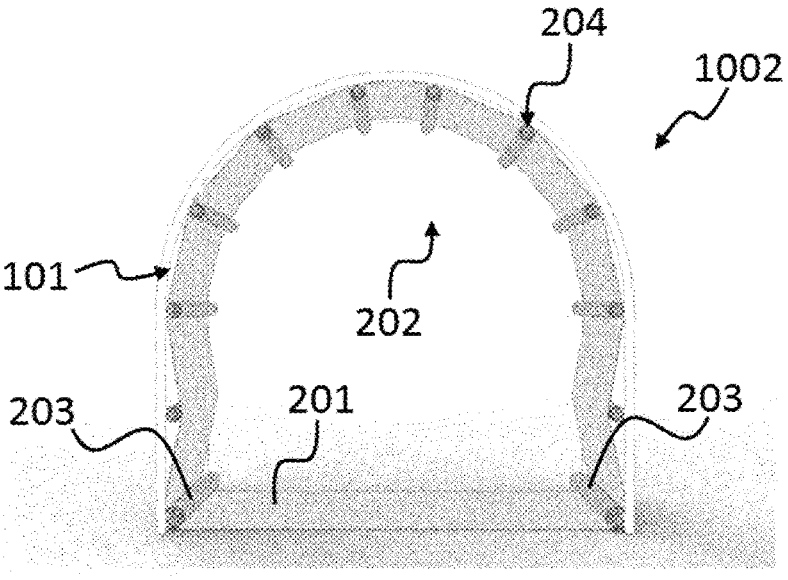
FIG. 14 illustrates a third embodiment of an apparatus for physical activity according to the invention.

FIG. 14 illustrates a third embodiment of an apparatus 1002 for physical activity according to the invention.

The apparatus 1002 comprises a frame 101 which is substantially arch-shaped, mounting a plurality of rollers 203, 204 upon which the belt is mounted in a never-ending loop, as already described.

The return belt surface 202, once again, is elevated with respect to the activity belt surface 201, thereby realizing an activity belt surface 201 with improved accessibility.

The tensioning system of apparatus 1002 provides for one or more displaceable rollers which increase the length of the belt's path thereby increasing the belt's tension, as already described. For particularly long belts, a tensioning system as the one described with reference to FIG. 4 may be used as well.

The apparatus 1002 is compact and lightweight.

In general, if so desired, it is possible to insert appropriate accessories below the activity belt surface 201, in order to vary inclination and/or tactile properties thereof.

Preferably, the belt 200 can be decorated with color patterns or images, also for making the belt resemble a natural surface or the actual room's floor.

In general, certain features described in connection with one specific embodiment, can be also applied to other embodiments herein described.

INDUSTRIAL APPLICABILITY

The apparatus for physical activity according to the present invention allows for a better access to the activity belt surface. Also, the risk of falling from the activity belt surface is reduced.

The apparatus for physical activity according to the present invention allows for improved modes of operation and functionalities.

The apparatus for physical activity according to the present invention can be more easily integrated within an environment, especially in household applications.

The apparatus for physical activity according to the present invention can be effectively used in physical rehabilitation centers, gyms, ships or confined spaces wherein people would benefit from walking, offices, private homes.

Although the present invention has been described in considerable detail with reference to certain preferred embodiments thereof, other variants may become apparent to those skilled in the art who consider the present description.

For example, several overall configurations of the apparatus, other than the ones presented here, can be designed depending on the requirements.

According to a further aspect of the present invention, the apparatus comprising a revolving belt could be applied to transportation of goods or people, in that it comprises a moving belt which is in particular driven by a motor.

According to this further aspect, the present invention relates to a belt apparatus 100 comprising: a frame 101; a plurality of rollers 203, 204 rotatably connected to said frame 101; a belt 200 mounted on said plurality of rollers 203, 204 and revolving to define moving belt surfaces 201, 202, the belt 200 comprising: a transport belt surface 201 delimited by a side of said frame 101; a return belt surface 202 being configured for revolving said belt 200 in a never-ending loop; said return belt surface 202 is elevated with respect to said transport belt surface 201.

Therefore, the activity belt surface previously described can be effectively used as a transport surface, thereby defining a conveyor belt for transportation of goods or people.

The length of the transport surface can be varied according to the specific requirements. In general, the belt apparatus above disclosed comprises all the relevant features which have been described above, in connection to the apparatus for physical activity.

What is claimed is:

1. An apparatus for physical activity, comprising:

a frame;

a plurality of rollers rotatably connected to said frame;

a belt mounted on said plurality of rollers and revolving to define moving belt surfaces comprising:

an activity belt surface being configured for physical activity of at least one user and delimited by a side of said frame;

a return belt surface being configured for revolving said belt in a never-ending loop;

wherein said return belt surface is elevated with respect to said activity belt surface, wherein said frame is configured to define an elevated loop structure, so that said return belt surface runs above said activity belt surface, and wherein said elevated loop structure is sized so as to allow said at least one user to stand on said activity belt surface while below said return belt surface.

2. The apparatus of claim 1, wherein said activity belt surface is on a floor level.

3. The apparatus of claim 2, further comprising a sliding table for supporting a bottom side of said activity belt surface, and for reducing friction thereof.

4. The apparatus of claim 3, wherein said sliding table further comprises at least one lateral ramp section for access to said activity belt surface.

5. The apparatus of claim 4, wherein said at least one lateral ramp section is further configured for centering said activity belt surface.

6. The apparatus of claim 3, further comprising a damping layer below said sliding table, to reduce impact shocks for said at least one user.

7. The apparatus of claim 1, further comprising a tensioning system for said belt.

8. The apparatus of claim 7, wherein said tensioning system comprises a displacer associated to at least one of said rollers to vary a length of said never-ending loop.

9. The apparatus of claim 1, wherein said belt comprises a flexible material band.

10. The apparatus of claim 1, further comprising at least one motor associated to at least one driving roller of said plurality of rollers.

11. The apparatus of claim 1, further comprising a detection system for detecting a position of said at least one user on said activity belt surface.

12. The apparatus of claim 11, further configured for controlling a revolving speed of said belt depending on said detected position of said at least one user.

13. The apparatus of claim 1, further comprising a multimedia system.

14. The apparatus of claim 1, wherein said at least one user is a human user.

* * * * *